United States Patent [19]

Laurendeau et al.

[11] Patent Number: 4,565,501

[45] Date of Patent: Jan. 21, 1986

[54] TWO-STAGE VOLUMETRIC PUMP FOR LIQUEFIED PETROLEUM GASES IN LIQUID PHASE

[75] Inventors: Gilles H. Y. Laurendeau, Rouen; Jean-Bernard G. H. Leprince, Louviers, both of France

[73] Assignee: Shell Oil Company, Houston, Tex.

[21] Appl. No.: 654,032

[22] Filed: Sep. 21, 1984

Related U.S. Application Data

[63] Continuation of Ser. No. 487,394, Apr. 21, 1983, abandoned.

[30] Foreign Application Priority Data

Apr. 21, 1982 [FR] France ..... 82 06867

[51] Int. Cl.[4] ..... F04B 25/04; F04B 11/00

[52] U.S. Cl. ..... 417/267; 417/383; 417/534; 92/48; 92/101

[58] Field of Search ..... 417/254, 243, 244, 267, 417/393, 383, 413, 418, 412, 397, 534; 92/101, 48, 151, 38, 97

[56] References Cited

U.S. PATENT DOCUMENTS

| | | | |
|---|---|---|---|
| 862,867 | 8/1907 | Eggleston | 417/390 |
| 2,584,552 | 2/1952 | Neufeld | 92/101 |
| 2,621,594 | 12/1952 | Katcher | 92/48 |
| 2,752,854 | 7/1956 | Prior et al. | 417/383 |
| 2,778,541 | 1/1957 | Sherdondy | 92/101 |
| 2,869,585 | 1/1959 | Baker | 92/101 |
| 2,919,652 | 1/1960 | Fay | 417/254 |
| 3,782,863 | 1/1974 | Rupp | 417/393 |
| 4,021,157 | 5/1977 | Elderfield | 417/383 |
| 4,172,698 | 10/1979 | Hinz et al. | 417/393 |
| 4,382,750 | 5/1983 | Robertson et al. | 417/397 |

FOREIGN PATENT DOCUMENTS

| | | | |
|---|---|---|---|
| 2420671 | 11/1979 | France | 417/534 |

*Primary Examiner*—Cornelius J. Husar
*Assistant Examiner*—Peter M. Cuomo

[57] ABSTRACT

A two-stage pump for LPG having two chambers, a valve communicating with the first chamber for the admission of the liquid to be pumped; a second valve communicating with the second chamber for the delivery of the pumped liquid. A transfer duct connects the two chambers and is fitted with a check valve to prevent the return of liquid from the second chamber to the first. Each chamber comprises a wall formed by a diaphragm freely deformable in such direction as to increase the volume of the chamber under the effect of the pressure of the liquid, and operably deformable in the opposite direction under the action of actuating means acting alternately on the diaphragms of both chambers. The floating diaphragms prevent the vaporization of the liquid that would arise with a suction pump, as well as the cavitation that would ensue.

3 Claims, 3 Drawing Figures

FIG_1
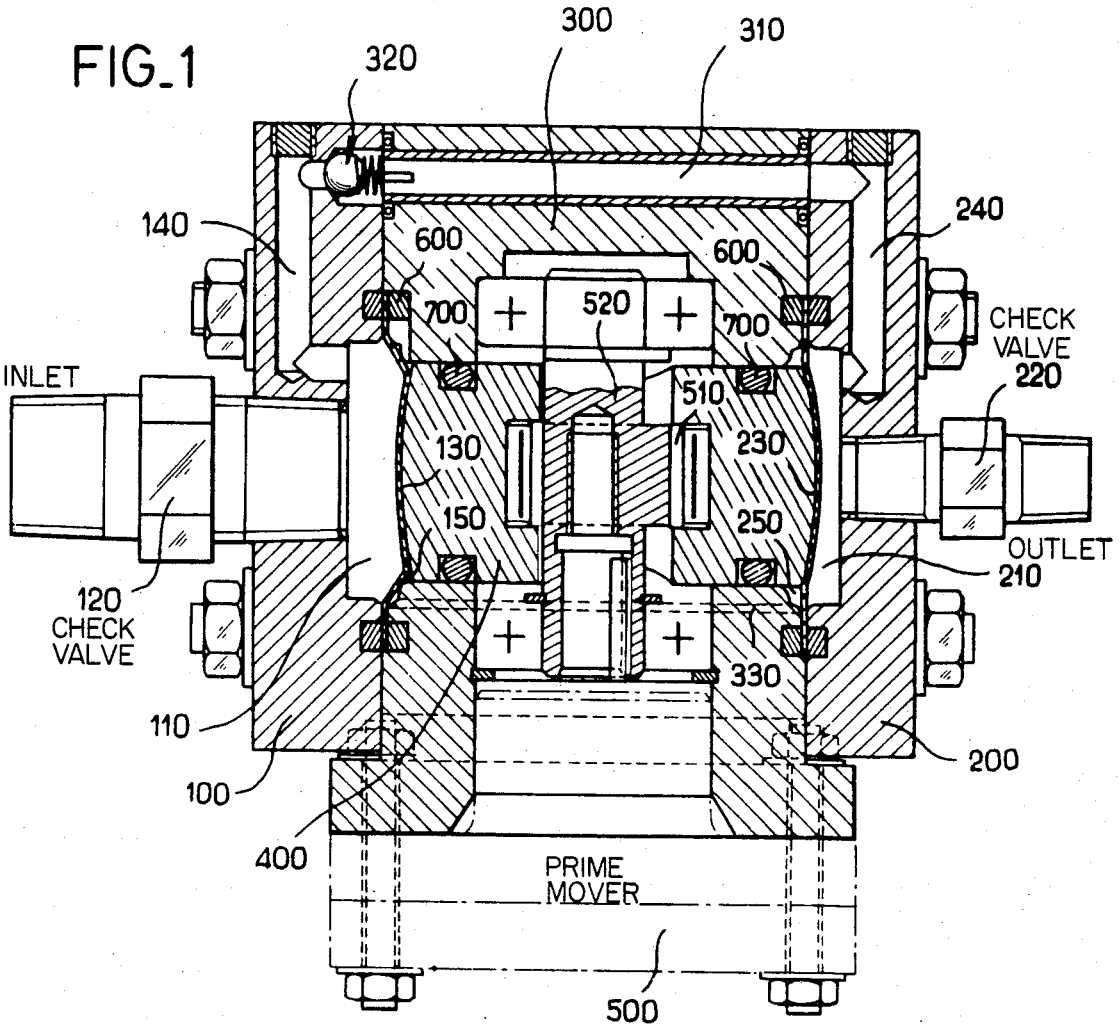
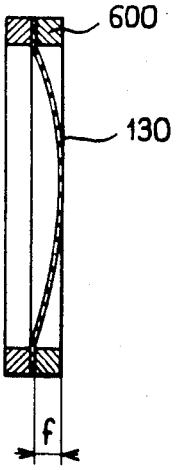
FIG_3
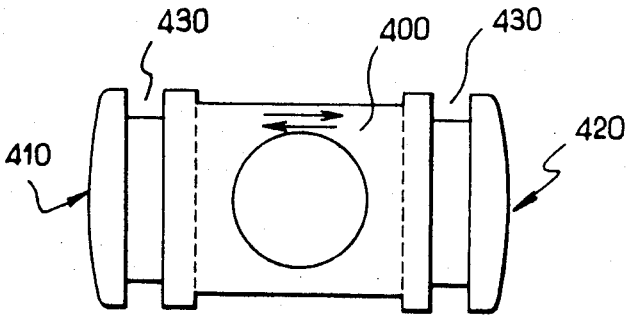
FIG_2

TWO-STAGE VOLUMETRIC PUMP FOR LIQUEFIED PETROLEUM GASES IN LIQUID PHASE

This is a continuation of application Ser. No. 487,394 filed Apr. 21, 1983, now abandoned.

BACKGROUND OF THE INVENTION

The present invention relates to a two-stage positive displacement pump for liquefied petroleum gases ("LPG") in liquid phase and particularly to a fuel injection process featuring such a pump for motor vehicle engines. One of the aims of the invention is to design such a pump of low power that can be used for the feeding of liquid fuel to motor vehicle engines running on LPG, suitable, for example, for private vehicles or small utility vehicles. To be suitable for use in motor vehicles, the pump must exhibit the features of compactness, low manufacturing cost and low power consumption (particularly if electrically powered).

The engineering techniques currently employed for high power LPG pumps (several $m^3$/hour) are difficult to transpose to the designing of low power pumps (several liters or tens of liters per hour). Of the two types of pump used, centrifugal pumps or gear pumps, neither lends itself to minaturization sufficient to permit its use in motor vehicles: the difficulties inherent in the use of liquid LPG (elevated pressure at pump outlet, delubricating effect, solvency, low viscosity) would make the design of miniature centrifugal pumps difficult and expensive.

Besides, existing small-size gear pumps cannot withstand the delubricating effect of LPG, unless the gears are adjusted somewhat slackly, which leads to overdimensioning and to a high rate of leakage, or unless special materials are used and very fine machining is performed, which leads to prohibitive manufacturing costs.

Another difficulty encountered in the pumping of liquid LPG derives from the fact that the liquid stored in the tank is in equilibrium with its own saturated vapor. Any drop in pressure—for example, due to leakage or to suction—causes bubbles of gas to appear within the liquid. For this reason, it is impossible to use conventional piston or diaphragm pumps for the pumping: during the suction phase, vaporization of the LPG takes place and the compression phase mainly serves to reliquefy the vaporized volume; efficiency is therefore very low and in particular cavitation will occur, leading to rapid deterioration of the pump components.

SUMMARY OF THE INVENTION

To overcome these drawbacks, the invention proposes a novel pump of the two-stage type, i.e., comprising at least two chambers, a non-return or check valve, communicating with the first chamber, for the admission of the liquid to be pumped, a valve, communicating with the second chamber for the delivery of the pumped liquid, and a transfer duct connecting two chambers fitted with a valve preventing the return of liquid from the second chamber to the first.

According to the invention, each chamber comprises a wall formed by a diaphragm freely deformable in such direction as to increase the volume of the chamber under the effect of the pressure of the liquid, and operably deformable in the opposite direction under the action of actuating means acting alternately on the diaphragms of both chambers.

As distinct from the diaphragms of a conventional diaphragm pump, which are integral with the actuating element (e.g. piston or rod), the diaphragms of the pump accordng to the invention are "floating", that is to say, they are free to move (passive) in the chamber-filling direction, and are forced to move in the discharge direction; filling is effected solely by the pressure of LPG vapor acting on the diaphragm. Admission is therefore effected without suction, and the only pressure drop discernible is due to head losses in the pipes.

The delivery phase is conventional; the diaphragm—activated by, for example, coming into contact with a driving element—discharges the liquid by reducing the volume of the chamber.

Preferably, in the absence of external activation, the diaphragms exhibit a permanent deformation with an amount flexing closely equivalent to the stroke of the actuating means. The floating property of the diaphragms thus becomes operative as soon as the direction of translation of the actuating means is reversed, and any elastic deformation caused by said means is avoided.

The actuating means may consist of a piston to which a reciprocating movement is imparted by an eccentric and which is provided with two pressure surfaces, for example spherical, arranged on either side of the eccentric.

Since the diaphragms ensure that the two chambers are totally leaktight, it is equally possible to use as a variant hydraulic or pneumatic actuating means; in that case, a transmitter mechanism external to the pump, cooperating with a set of valves, would impart to an intermediate liquid impulses which would alternately and regularly deform the diaphragms in order to enable the liquid to be discharged from each chamber.

The pump according to the invention may be arranged between the LPG tank and the user components; it may equally well be immersed inside the tank. In the latter case, the use of hydraulic or pneumatic actuating means would enable all safety requirements to be satisfied.

The fuel injecton process consists of injecting liquid LPG, the injection pressure of which is attained by means of the pump according to the invention, into the combustion chamber of a motor vehicle engine.

BRIEF DESCRIPTION OF THE DRAWINGS

The above mentioned features and other advantages of the invention will become apparent from the detailed description below when taken with reference to the appended drawings, in which:

FIG. 1 is a vertical section of a pump according to the invention;

FIG. 2 is a top view of the diaphragm-actuating piston; and

FIG. 3 is a section of one of the diaphragms in the absence of any external activation.

DESCRIPTION OF A PREFERRED EMBODIMENT

The pump is made of two end caps 100 and 200 mounted on either side of a body 300. These two end caps define two chambers 110 and 210 corresponding to the two stages of the pump.

The first chamber 110 is connected to the tank of liquid to be pumped by means of an admission valve 120, which must be of the non-return type. One of the chamber walls consists of a deformable diaphragm 130 enabling the volume of said chamber to be varied. A passageway 140 allows the liquid to be discharged to the second chamber by means of a transfer passageway 310 fitted with a non-return valve 320.

The second chamber 210 is of a similar configuration but plays an opposite role; it communicates with the user components by means of a delivery valve 220, optionally of the non-return type, and receives the liquid coming from the first chamber through an inlet passageway 240. The diaphragm 230 which forms one of the walls is identical to the diaphragm 130 of the first chamber.

The LPG pressure at the pump outlet is of the order of some ten bars, that is to say, distinctly higher than the liquid/vapor equilibrium pressure, in order to avoid any in-line vaporization, even in the event of local overheating.

The diaphragms are actuated by a piston 400, also shown as a top view in FIG. 2. In FIG. 1, the piston has been represented in the position corresponding to maximum translation towards the right of the illustration, i.e., for maximum volume of the first chamber and for minimum volume of the second chamber; this position will hereinafter be designated the "high dead point" and the opposite position the "low dead point".

The piston has two surfaces 410 and 420, for contacting the diaphragms 130 and 230 but not integral with them, to make them "floating" (increase of volume of chamber without suction, solely by passive translation of the diaphragm under the thrust of the liquid).

The contact surfaces are preferably spherical, which permits gradual contact with the diaphragm. The piston 400 is driven in a reciprocating movement by a prime mover and reducing gear 500 which rotates an eccentric 510 mounted on a crankshaft 520.

The leaktightness of the end caps of each stage is ensured by seals such as 600. O-rings 700, arranged in grooves 430 of the piston, ensure a leaktight seal between the latter and the pump body 300.

The leaktight seal between the piston and chambers is ensured by the floating diaphragms 130 and 230. This arrangement characteristically avoids cavitaion. In the event of rupture of a diaphragm, the pump could continue to operate but with reduced performance as it would then become a suction pump. The leaktight seal with the outside would be—partially— maintained by the O-rings 700. There would then be a vaporization of the liquid inside the pump, with the aforesaid risks of cavitation. To avoid pump malfunctioning under such conditions, a safety passage 330 connects the spaces 150 and 250 located behind the diaphragms that equalize pressure between the two stages and interrupts operation of the pump by bypassing it.

FIG. 3 shows one of the diaphragms, for example, the diaphragm 130, alone. In the absence of external activation, it has a permanent flexional deformation f in order to enhance its "floating" property. The diaphragm is preferably made of an elastomeric material and the leaktight seals 600 are vulcanized direct to the circumference of the diaphragm.

Operation of the pump is as follows: when the piston is translated to the right, that is to say from the low dead point to the high dead point, it allows the diaphragm 130 to deform under the pressure of the liquid LPG filling the first chamber via the non-return admission valve. The valve causes a loss of head, and the transfer of liquid is therefore effected with a slight expansion; consequently, a fraction of the gas is vaporized (this vaporization being, however, limited by the absence of suction; it is solely the head losses in the pipes of admission valves which cause expansion).

Once the first chamber is filled, the direction of translation of the piston is reversed and the latter is translated towards the low dead point. Pressure in the first chamber increases and the vaporized fraction of the liquid re-liquefies. At the same time, the admission valve 120 closes and the liquid is transferred toward the second chamber via the transfer valve 320. The second chamber's diaphragm is free to deform in such direction that the volume of said chamber increases.

Finally, after re-inversion of the direction of piston translation, said piston compresses the second chamber's diaphragm and discharges the liquid toward the user components via the delivery valve 220 (simultaneously, the first-chamber admission phase described above is initiated; the transfer valve 320 ensures that admission into the first chamber and discharge from the second chamber are independent of one another).

The diaphragms may be actuated by hydraulic or pneumatic means instead of the reciprocating piston described above. The hydraulic or pneumatic means could comprise a source of pressurized fluid that is supplied to and exhausted from chambers on the side of the diaphragms opposite the pump chambers 110 and 210. The flow of the fluid could be controlled by a properly timed valve such as a rotary valve, or a piston valve operated by a solenoid. Electrical timing circuits could be used to control the solenoid. Also, a solenoid could be used to reciprocate the piston 400 directly.

What is claimed is:

1. A positive displacement pump having at least two stages for pumping liquefied petroleum gases in substantially a liquid form, said pump comprising:

a housing;

at least two separate chambers formed in said housing, each chamber have one wall that is formed by a diaphragm, said diaphragm being freely deformable in a direction to increase the volume of each chamber and deformable in the opposite direction under the action of actuating means;

a passageway connecting said chambers, said passageway having a non-return valve positioned therein for allowing flow from a first one of said chambers to the other of said chambers while preventing flow from the other chamber to the first chamber;

an inlet means for said first one of said chambers, said inlet means having a non-return valve positioned therein to allow fluid to flow into said first one of said chambers;

an outlet means for said other of said chambers, said outlet means having a non-return valve positioned therein to allow fluid to flow out of said other chamber of said chambers;

a double ended piston disposed in said housing, each end of said piston contacting one of said diaphragms, said piston being sealed in said housing to isolate said chambers from the outside;

a driving means coupled to said piston to reciprocate said piston; and a passageway disposed to connect the spaces on the side of said diaphragm opposite said pump chambers to equalize the pressures in said spaces.

2. The pump of claim 1, wherein said diaphragms are formed of an elastomer material.

3. The pump of claim 1 or 2, wherein said driving means is an eccentric.

* * * * *